US006119652A

United States Patent [19]

Waples et al.

[11] Patent Number: 6,119,652

[45] Date of Patent: Sep. 19, 2000

[54] THROTTLE VALVE ASSEMBLY

[75] Inventors: Jon J. Waples, Ann Arbor, Mich.; Ronald D. Kurth, Sylvania, Ohio

[73] Assignee: Ford Motor Company, Dearborn, Mich.

[21] Appl. No.: 09/072,124

[22] Filed: May 4, 1998

[51] Int. Cl.[7] ..... F02D 9/08

[52] U.S. Cl. ..... 123/337; 251/305

[58] Field of Search ..... 123/337; 251/305

[56] References Cited

U.S. PATENT DOCUMENTS

| | | | |
|---|---|---|---|
| 4,465,260 | 8/1984 | Conley et al. | 251/305 |
| 4,509,720 | 4/1985 | Griffin et al. . | |
| 4,526,060 | 7/1985 | Watanabe . | |
| 5,016,586 | 5/1991 | Imamura et al. | 123/337 |
| 5,168,849 | 12/1992 | Gerhardt et al. . | |
| 5,370,148 | 12/1994 | Shafer | 251/305 |
| 5,497,081 | 3/1996 | Wolf et al. . | |
| 5,522,361 | 6/1996 | Pickman et al. . | |
| 5,624,100 | 4/1997 | Bolte et al. . | |
| 5,666,988 | 9/1997 | Becker | 251/308 |
| 5,746,177 | 5/1998 | Criss et al. | 251/308 |
| 5,788,218 | 8/1998 | Goldman | 251/306 |
| 5,878,715 | 3/1999 | Hernandez et al. | 123/337 |

*Primary Examiner*—John Kwon
*Attorney, Agent, or Firm*—Jerome R. Drouillard

[57] ABSTRACT

A throttle valve assembly for an internal combustion engine includes a throttle body having a bore formed therein and a sidewall having a throttle shaft opening formed therethrough. A throttle shaft passes through the throttle shaft opening and includes a shaped end. A disc shaped retainer is positioned within the opening and has a corresponding shaped opening for receiving the shaped end of the throttle shaft. When the shape end of the throttle shaft passes through the shaped end of shaped opening of the retainer, the throttle shaft is rotated relative to the retainer to create an interference engagement therewith so as to retain the throttle shaft within the throttle body to limit axial displacement thereof.

18 Claims, 2 Drawing Sheets

THROTTLE VALVE ASSEMBLY

FIELD OF THE INVENTION

This invention relates to throttle valve assemblies for use in automotive vehicles, and more particularly to, throttle valve assemblies having limited throttle shaft end play.

BACKGROUND OF THE INVENTION

Conventional throttle valve assemblies are mounted within the air intake stream of an internal combustion engine. Typically a butterfly valve such as a throttle plate is employed to control the amount of air flow through the throttle valve assembly. The throttle plate is mounted on the throttle shaft, which in turn is coupled to the vehicle accelerator pedal for actuation. Throttle valve assemblies typically incorporate a position sensor at the end of the throttle shaft. In order to maintain accuracy, a complex arrangement or the bearings and retainers are required to properly align the throttle shaft relative to the position sensor, to limit throttle shaft end play (axial displacement). These complex systems typically require extensive time in the assembly process resulting in increased component price.

SUMMARY OF THE INVENTION

The object of the invention is to provide a throttle valve assembly having limited throttle shaft end play, while requiring minimal complexity. This object is achieved, and disadvantages of prior art overcome, by providing a novel throttle valve assembly for an internal combustion engine. In one particular aspect of the invention the throttle valve assembly includes a throttle body having a bore formed therein and defining a longitudinal axis. A sidewall of the body includes a throttle shaft opening formed therethrough. A throttle shaft having an axis is received within the body substantially perpendicular to the throttle body axis and passes through the throttle shaft opening. The throttle shaft has a shaped end. A retainer is positioned in the opening and has a corresponding shaped opening for receiving the shaped end of the throttle shaft. When the throttle shaft passes through the shaped opening of the retainer, the throttle shaft is rotated relative to the retainer to create an interference engagement therewith so as to retain the shaft within the throttle body thereby limiting axial displacement of the shaft relative to the body.

An advantage of the present invention is that a less complex throttle valve assembly is provided.

Another advantage of the present invention is that a less costly throttle position sensor may be utilized with the throttle valve assembly.

In a preferred embodiment, the assembly also includes a throttle plate mounted on the throttle shaft within the throttle bore. The shaped end of the throttle shaft is in a relatively minimum interference engagement when the throttle plate is in an idle position and in a relatively maximum interference engagement when the throttle plate is in a wide open position.

An advantage of having the shaped end in maximum interference engagement with the retainer when the throttle plate is in a wide open position is that the throttle plate itself, when in this position, may provide only limited axial slip of the throttle shaft.

Other objects features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figures 1, 6, 7:
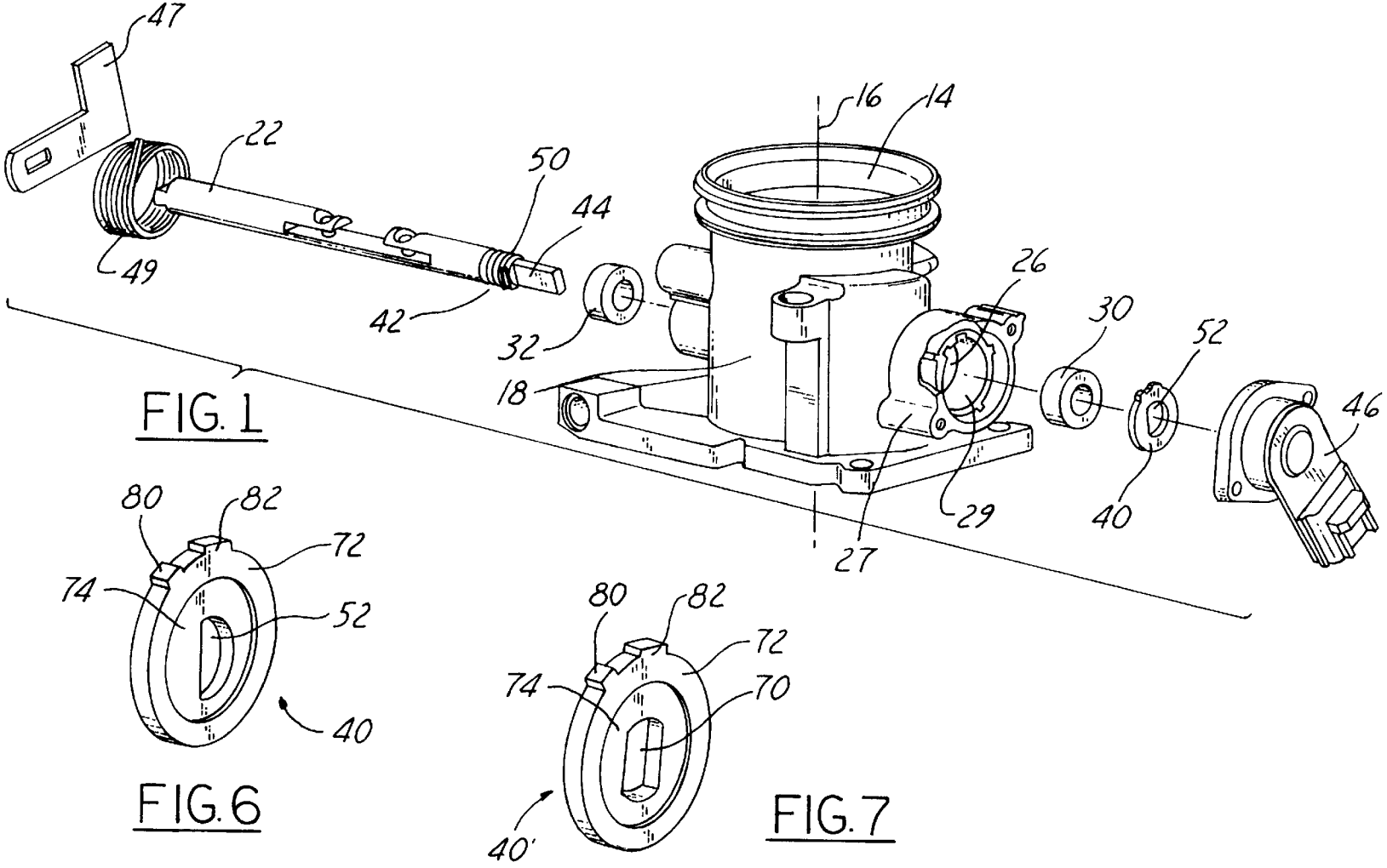
FIG. 1 is an exploded perspective view of the throttle valve assembly according to the present invention.
FIG. 6 is a perspective view of the retainer used in the present invention; and, FIG. 7 is an alternative embodiment of the retainer for use in the present invention.

Throttle valve assembly 10, shown in FIGS. 1–5, includes plastic throttle body 12 having bore 14 passing therethrough and defining axis 16. Body 12 further includes sidewall 18, shown in this example as a cylindrical sidewall. Body 12 is adapted to be connected to an induction system of an internal combustion engine (not shown). Throttle valve assembly 10 includes throttle plate 20 for controlling air flow through bore 14. In a typical arrangement, throttle plate 20 is mounted to throttle shaft 22 via screws 24. During assembly, throttle shaft 22 is inserted through sidewall 18 and passes through throttle shaft opening 26. Once fully inserted, throttle plate 20 is attached to throttle shaft 22. Throttle shaft 22 is aligned relative to axis 16 such that axis 28 of throttle shaft 22 is substantially perpendicular to axis 16. To provide free rotation of throttle shaft relative to body 12, bearings 30, 32 are disposed about throttle shaft 22 and at least bearing 30 is fixed within a portion of throttle shaft opening 26. In the embodiment described herein, throttle body 12 includes housing portion 27 surrounding throttle shaft opening 26 and defining bearing/retainer pocket 29. Retainer 40, which may be made of a metal or plastic material, is placed over end 42 of throttle shaft 22 to retain throttle shaft 22 within throttle body 12. Throttle shaft end 42 also includes extension 44 for insertion into position sensor 46. Position sensor 46 is sensitive to rotation of shaft 22 and is connected to an electronic engine control (not shown) to detect the position of throttle shaft 22 and consequently throttle plate 20. Those skilled in the art will recognize in view of this disclosure that throttle position is important for vehicle engine controls. Position sensor 46 is secured to housing portion 27. Throttle valve assembly 10 further includes actuation lever 47 coupled to the accelerator pedal (not shown) and return spring 49 for rotating shaft 22. Alternatively, those skilled in the art will recognize in view of this disclosure that an electronically actuated throttle valve may be used.

According to the present invention, throttle shaft 22, in order to cooperate with position sensor 46, must have limited axial displacement along axis 28. To accomplish this, throttle shaft 22 is formed with a D-shaped end. Disc-shaped retainer 40 includes a corresponding D-shaped opening 52 for receiving D-shaped end 50 of throttle shaft 22. Upon assembly, throttle shaft 22 passes through D-shaped opening 52 and is rotated relative to retainer 50 to create an interference engagement therewith so as to retain shaft 22 within throttle body 12 to limit axial displacement along axis 28 away from position sensor 46. Throttle shaft 22 may further include a boss (not shown) having a size greater than the size of D-shaped opening 52 such that shaft 22 is restrained from moving toward position sensor 46.

Figure 2:
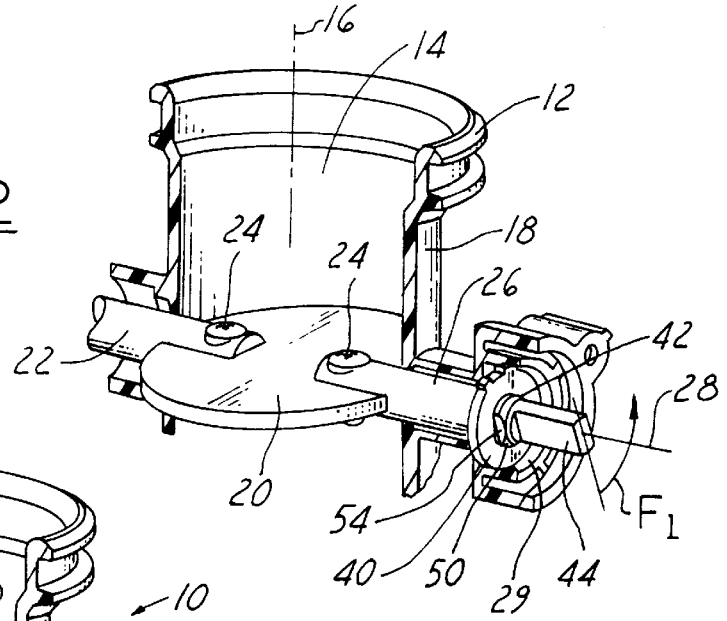
FIGS. 2 and 3 are partial section perspective views of the throttle valve assembly shown in the idle position and in the wide open throttle position, respectively.
Figure 3:
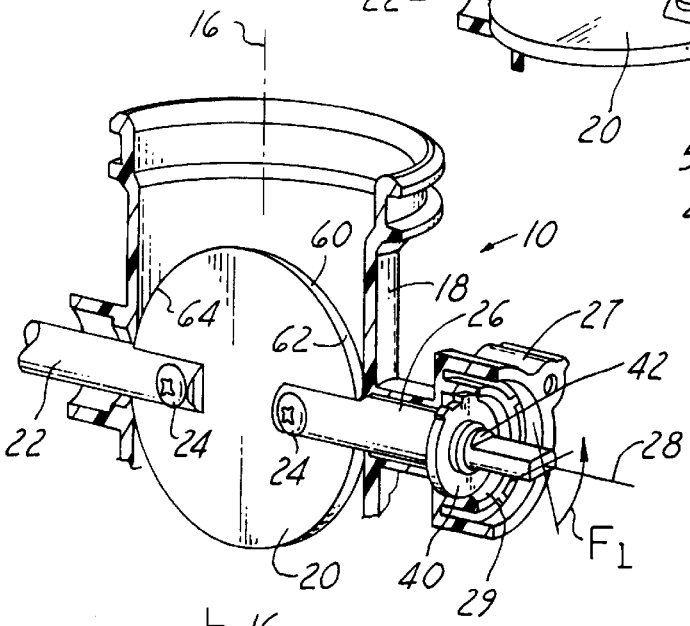
Figure 4:
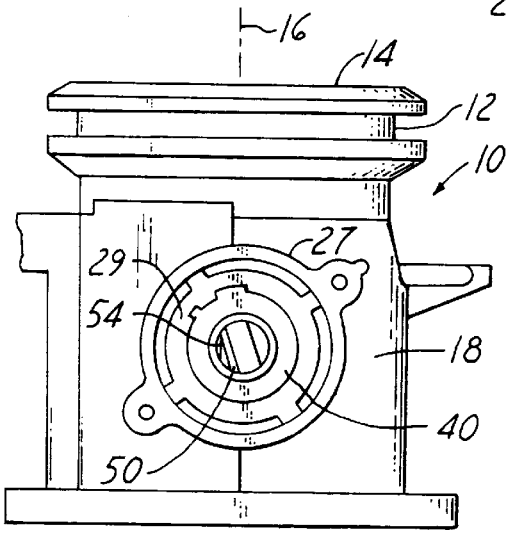
FIGS. 4 and 5 are end views of the throttle valve assembly shown in the idle position and in the wide open throttle position, respectively.
Figure 5:
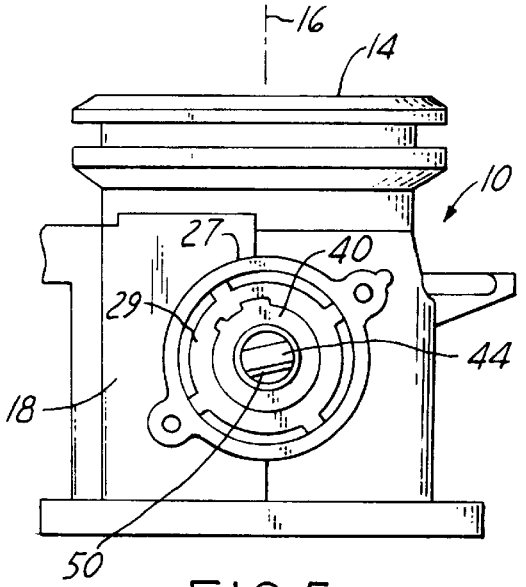

As shown in FIGS. 2 and 4, when throttle plate 20 is in the idle position, D-shaped end 50 of throttle shaft 22 is in a relatively minimum interference engagement with retainer 52. This is shown best in FIG. 2 where a portion 54 of end 50 engages retainer 52. Once throttle shaft 22 is engaged within retainer 50, retainer 40 is heat staked to housing portion 27 and an idle set screw (not shown) is adjusted such that throttle shaft 22 is prevented from rotating in a clock wise direction (opposite arrow F1). For the sake of clarity, bearing 30 is not shown in FIG. 2. Referring now to FIGS. 3 and 5, when throttle plate 20 is in a wide open throttle position, end 50 is in a relatively maximum interference engagement with retainer 40. Thus, according to the present invention, when throttle plate 20 is in a wide open throttle position, as best shown in FIG. 3, retainer 40 provides a maximum retention of throttle shaft 22. Also for the sake of clarity, bearing 30 is not shown in FIG. 3.

According to the present invention, as shown in FIG. 3, maximum interference engagement occurs when throttle plate 20 is in the wide open position. In contrast, as shown in FIG. 2, when throttle plate 20 is in the idle position, retainer 40 may provide only a minimal interference engagement to retain shaft 22 relative to body 12. This may be desirable because, in the wide open position, throttle plate 20 may provide only minimal retention of throttle shaft 22, (see FIG. 3, where circumference 60 of throttle plate 20 may provide only limited engagement with the inner wall of bore 14, shown at locations 62, 64), whereas, in the idle position, circumference 60 may provide a maximum retention of shaft 22 because substantially the entire circumference 60 contacts the inner wall of bore 14.

Referring now to FIGS. 6 and 7, alternative embodiments according to the present invention are shown. FIG. 6 shows retainer 40 having D-shaped opening 52 as previously described. FIG. 7 shows retainer 40' having oval-shaped opening 70, which cooperates with a corresponding oval-shaped end of throttle shaft 22. In both embodiments, inwardly facing surface 72 of retainer 40, 40' is positioned, when assembled within body 12, adjacent bearing 30. Inwardly facing surface 72 has a recess 74 formed thereon which allows clearance between retainer 40 and bearing 30 such that, as bearing 30 may rotate, the entire inwardly facing surface 72 is prevented from contacting bearing 30 to provide minimal frictional interference therewith.

Continuing with FIGS. 6 and 7, retainers 40, 40' each may include two radially extending tabs 80, 82, which fit within cooperating recesses formed in housing portion 27 for radially locating retainers 40 or 40' therein. In addition, radially extending tab 80 has a different configuration than radially extending tab 82 (in this example, the configuration being different sizes) such that retainers 40, 40' may be placed in only one orientation within pocket 27. Those skilled in the art will recognize in view of this disclosure that any configuration may be used to distinguish tab 80 from tab 82.

While the best mode for carrying out the invention has been described in detail, those skilled in the art in which this invention relates will recognize various alternative designs and embodiments, including those mentioned above, in practicing the invention that has been defined by the following claims.

We claim:

1. A throttle valve assembly for an internal combustion engine comprising:

a throttle body having a bore formed therein defining a longitudinal axis, and a sidewall having a throttle shaft opening formed therethrough;

a throttle shaft having an axis and being received within said body substantially perpendicular to the longitudinal axis of the throttle body and passing through said throttle shaft opening, with said throttle shaft having a shaped end including a radial projection, the radial projection having a first surface generally normal to the axis of said throttle shaft; and a retainer positioned in said opening, with said retainer having a shaped opening for receiving said shaped end of said throttle shaft and allowing the first projection of said shaped end to pass therethrough when said shaped end is in a first angular position relative to said retainer, whereupon rotation of said throttle shaft from the first angular position to a second angular position relative to said retainer creates an axial interference between the first surface of the radial projection of said shaped end and said retainer to retain said throttle shaft within said throttle body and thereby limit axial displacement of said throttle shaft relative to said throttle body.

2. An assembly as claimed in claim 1 further comprising a throttle plate mounted on said throttle shaft within said throttle bore, with the radial projection of said shaped end of said throttle shaft being in relatively minimum axial interference engagement with said retainer when said throttle plate is in an idle position and in relatively maximum axial interference engagement with said retainer when said throttle plate is in a wide open position.

3. An assembly as claimed in claim 1 wherein said throttle shaft is prevented from rotating back to the first angular position relative to said retainer after said throttle shaft has been rotated to said second angular position, thereby maintaining said axial interference engagement.

4. An assembly as claimed in claim 1 wherein said shaped opening of said retainer is a generally D-shaped opening.

5. An assembly as claimed in claim 1 wherein said shaped opening of said retainer is a generally oval-shaped opening.

6. An assembly according to claim 1 further comprising a bearing disposed about said throttle shaft and within said throttle shaft opening, with said retainer retaining said bearing in said throttle shaft opening when the first surface of the radial projection of said shaped end is in axial interference engagement with said retainer.

7. An assembly according to claim 6 wherein said retainer comprises a disc-shaped member having said shaped opening formed therein, and an inwardly facing surface positioned adjacent said bearing, with said inwardly facing surface having a recess formed thereon, with said recess providing a clearance between said bearing and said inwardly facing surface to reduce friction therebetween.

8. An assembly according to claim 6 wherein said retainer comprises a radially locating member formed thereon for radially locating said retainer relative to said throttle shaft opening.

9. An assembly according to claim 6 wherein said retainer comprises at least one radially extending tab, with said tab engaging a mating recess formed in said throttle shaft opening to thereby radially locate said retainer within said throttle shaft opening.

10. An assembly according to claim 6 wherein said retainer comprises at least two radially extending tabs, with said tab engaging a mating recess formed in said throttle shaft opening to thereby radially locate said retainer within said throttle shaft opening, with one said tab having a configuration different from the other said tab so that said retainer fits into said throttle shaft opening in a single orientation.

11. A throttle valve assembly for an internal combustion engine comprising:

a throttle body having a bore formed therein defining a longitudinal axis, and a sidewall having a throttle shaft opening formed therethrough;

a throttle shaft having an axis and being received within said body substantially perpendicular to the longitudinal axis of said throttle body and passing through said throttle shaft opening, with said throttle shaft having a shaped end including a radial projection, the radial projection having a first surface generally normal to the axis of said throttle shaft;

a bearing disposed about said throttle shaft and within said throttle shaft opening; and, a retainer positioned in said throttle shaft opening, with said retainer having a shaped opening for receiving said shaped end of said throttle shaft and allowing the radial projection on said shaped end to pass therethrough when said shaped end is in a first angular position relative to said retainer, whereupon subsequent rotation of said throttle shaft from the first angular position to a second angular position relative to said retainer creates an axial interference between the first surface of the radial projection of said shaped end and said retainer to retain said throttle shaft within said throttle body and thereby limit axial displacement of said throttle shaft relative to said body, with said throttle shaft being prevented from rotating back to the first angular position relative to said retainer after said throttle shaft has been rotated to said second angular position, thereby maintaining said axial interference engagement, and with said retainer retaining said bearing in said throttle shaft opening when the first surface of the radial projection of said shaped end is in axial interference engagement with said retainer.

12. An assembly as claimed in claim 11 further comprising a throttle plate mounted on said throttle shaft within said throttle bore, with said shaped end of said throttle shaft being in relatively minimum axial interference engagement when said throttle plate is in an idle position and in relatively maximum axial interference engagement when said throttle plate is in a wide open position.

13. An assembly as claimed in claim 11 wherein said shaped throttle opening is a generally D-shaped opening.

14. An assembly as claimed in claim 11 wherein said shaped throttle opening is a generally oval-shaped opening.

15. An assembly according to claim 11 wherein said retainer comprises a disc-shaped member having said shaped opening formed therein, and an inwardly facing surface positioned adjacent said bearing, with said inwardly facing surface having a recess formed thereon, with said recess providing a clearance between said bearing and said inwardly facing surface to reduce friction therebetween.

16. An assembly according to claim 11 wherein said retainer comprises at least two radially extending tabs, with said tab engaging a mating recess formed in said throttle shaft opening to thereby radially locate said retainer within said throttle shaft opening, with one said tab having a configuration different from the other said tab so that said retainer fits into said throttle shaft opening in a single orientation.

17. An assembly according to claim 11 wherein said retainer is heat staked to said throttle body.

18. A throttle valve assembly for an internal combustion engine comprising:

a throttle body having a bore formed therein defining a longitudinal axis, and a sidewall having a throttle shaft opening formed therethrough;

a throttle shaft having an axis and being received within said body substantially perpendicular to the longitudinal axis of said throttle body and passing through said throttle shaft opening, with said throttle shaft having a shaped end including a radial projection, the radial projection having a first surface generally normal to the axis of said throttle shaft;

a throttle plate mounted on said throttle shaft within said throttle bore;

a bearing disposed about said throttle shaft and within said throttle shaft opening; and, a disc-shaped retainer positioned in said opening, with said retainer having a corresponding shaped opening for receiving said shaped end of said throttle shaft and allowing the radial projection on said shaped end to pass therethrough when said shaped end is in a first angular position relative to said shaped opening, whereupon subsequent rotation of said throttle shaft to a second angular position relative to said shaped opening creates an axial interference engagement between the first surface of the radial projection of said shaped end and said retainer to retain said throttle shaft within said throttle body and thereby limit axial displacement of said shaft relative to said body, with said shaped end of said throttle shaft being in relatively minimum interference engagement when said throttle plate is in an idle position and in relatively maximum axial interference engagement when said throttle plate is in a wide open position, with said throttle shaft being prevented from rotating back to the first angular position after being rotated to the second angular position, thereby maintaining said interference engagement, and with said retainer, when in said axial interference engagement with said shaft, retaining said bearing in said throttle shaft opening, with said retainer being heat staked within said throttle shaft opening, with said retainer comprising:

an inwardly facing surface positioned adjacent said bearing, with said inwardly facing surface having a recess formed thereon, with said recess providing a clearance between said bearing and said inwardly facing surface to reduce friction therebetween; and, at least two radially extending tabs, with said tab engaging a mating recess formed in said throttle shaft opening to thereby radially locate said retainer within said throttle shaft opening, with one said tab having a configuration different from the other said tab so that said retainer fits into said throttle shaft opening in a single orientation.

* * * * *